United States Patent [19]

Neher

[11] Patent Number: 4,955,211

[45] Date of Patent: Sep. 11, 1990

[54] CIRCULAR KNITTING MACHINE FOR PRODUCING SINGLE FACE PLUSH ARTICLES

[75] Inventor: Paul Neher, Messstetten, Fed. Rep. of Germany

[73] Assignee: Sipra Patententwicklungs-und Beteiligungsgesellschaft mbH, Albstadt, Fed. Rep. of Germany

[21] Appl. No.: 233,274

[22] Filed: Aug. 17, 1988

[30] Foreign Application Priority Data

Aug. 17, 1987 [DE] Fed. Rep. of Germany ..... 3727318

[51] Int. Cl.[5] ..... D04B 9/12; D04B 15/06

[52] U.S. Cl. ..... 66/9 R; 66/93; 66/108 R; 66/136

[58] Field of Search ..... 66/9 R, 91, 93, 107, 66/108 A, 108 R, 136

[56] References Cited

U.S. PATENT DOCUMENTS 2,925,724 2/1960 Coile ..... 66/107

4,535,608 8/1985 Plath et al. ..... 66/9 R 4,665,718 5/1987 Jelinek et al. ..... 66/9 R

*Primary Examiner*—Wm. Carter Reynolds

*Attorney, Agent, or Firm*—Michael J. Striker

[57] ABSTRACT

A circular knitting machine for producing a single face plush article of base threads and plush threads has a needle cylinder provided with a plurality of needles and a plate ring provided with separately controlled and differently shaped plates. A first plate has a slot for receiving a base thread and a stepped ridge for applying a plush thread, and a second plate is provided with a recess in the region of the slot of the first plate. The second plate has a plate tip formed above the recess and is provided for a plaiting with a plush thread-pressing edge. The plush thread-pressing edge is formed on the plate tip and extends in an inclined manner to the slot of the first plate and to a shaft of an associated one of the needles. The plush thread pressing edge being movable to a point before a step of the stepped ridge of the first plate.

3 Claims, 4 Drawing Sheets

CIRCULAR KNITTING MACHINE FOR PRODUCING SINGLE FACE PLUSH ARTICLES

BACKGROUND OF THE INVENTION

The present invention relates to a circular knitting machine for producing a single face plush articles of base threads and plush threads. Circular knitting machines of the above mentioned general type are known in the art. A circular knitting machine of this type has a needle cylinder which is provided with a plurality of needles, a plate ring which is provided with separately controllable and differently shaped plates such that a first plate has a slot for receiving a base thread and a stepped ridge for applying a plush thread while a second plate is provided with a recess in the region of the slot of the first plate. Such circular knitting machine is disclosed in the German Patent No. 3,035,582 which corresponds to U.S. Pat. No. 4,535,608. This circular knitting machine insures that the plush and loop formation is finely influenced by a relative displaceability of both plates. Thereby, a normal plaiting is desired and obtained in such a manner that in the thus produced single face plush product, base thread appears on the plush hook-free side.

SUMMARY OF THE INVENTION

Accordingly, it is an object of the present invention to provide a circular knitting machine which is a further improvement of the existing circular knitting machines.

More particularly, it is an object of the present invention to provide a circular knitting machine which produces a plush article such that on both its sides only the plush thread is visible, and with which the required plaiting can be achieved without a reconstruction of the cams for controlling the knitting tool.

In keeping with these objects and with others which will become apparent hereinafter, one feature of the present invention resides, briefly stated, in a circular knitting machine in which for obtaining plaiting, the second plate is provided with a plush thread-pressing edge on a plate tip which is formed above the recess, and the plush thread-pressing edge is inclined toward the slot of the first plate and toward the shaft of the associated needle, and also the plush thread-pressing edge is movable up to a point before the step of the ridge of the first plate.

In the circular knitting machine for producing single-face plush articles, the plaiting of the plush hook-free article side is achieved only with the utilization of a specially designed second plate. For controlling this second plate and its relative displaceability to the first plate, no special parts are used. It can be processed with the same cam parts as disclosed in the above mentioned German Patent No. 3,035,582 (corresponds to U.S. Pat. No. 4,535,608), and respectively with special displaceable cam elements which act on the first plate or on the second plate. Special needles which are known for reverse plaiting and are more expensive then simple piercing needles must not be used.

It is basically known during the utilization of two special plates for producing plush products, to form on the second plate thread receiving notches, especially a throat for engaging the plush thread hook. However, here no special plaiting is desired, but this is the step for improving the plush hook position on the plush side, as disclosed for example in the German Patent No. 3,145,307 which corresponds to U.S. Pat. No. 4,612,784 or for securing the plush hook against pulling out of the plush thread on the rear side during formation of the subsequent loops and hooks for producing a normal plaited plush article in a regular and uniform manner. In correspondence with this, the shape of the second plate in those cases is different from the shape of the present invention.

The circular knitting machine in accordance with the present invention produces a plaited single face plush article in which the base threads also on the plush hook-free side is completely and neatly covered and during expansion of the plush article cannot become visible. Advantageously, for producing a good stretchability an elastic base thread can be used. The plaited plush article in accordance with the present invention can also be roughened on the plush hook-free side and processed to form a double-side fleecy article. By means of the inclined plush thread-pressing edge, a force component is applied to the plush thread during the hook and loop formation. This force component is favorable for the relative movement of both threads relative to one another in the needle head for the desired special plaiting and displaces both threads in the needle head to the needle shaft side.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
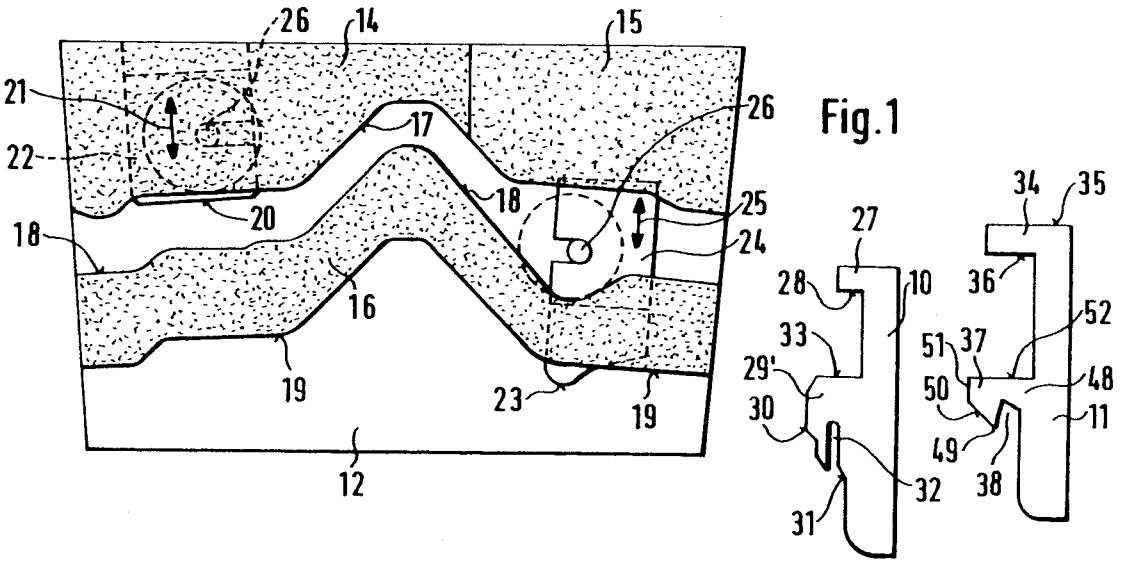
FIG. 1 is a plan view of cam parts of a system for controlling both plates, together with two plates on a side view.

FIG. 1 shows two cooperating plates of a circular knitting machine in accordance with the present invention. A first plate is a plush plate 10 and the second plate is a plaiting plate 11. FIG. 1 shows also a segment of a cam ring 12 with fixed cam parts 14, 15, 16 for the plates 10 and 11 which are screwed on the ring. The cam parts 14 and 15 can also be composed of a single part. For better distinguishing of their region, the immovably located cam parts 14, 15, 16 which can also be composed of several individual parts are identified by pointed areas. Both cam parts 14 and 15 together form a guiding edge 17. The movable cam part 16 forms a guiding edge 18 at its one side and a guiding edge 19 at its other side.

A portion of the guiding edge 17 is formed by a front edge 20 of a cam part 22 which is arranged behind the immovable cam part 14 and is adjustably movable in direction of the double arrow 21. Also, the guiding edge 19 of the immovable cam part 16 is overlapped at one location by a front edge 23 of an adjustable cam part 24 which is arranged behind the cam part 16. The adjustment direction of the cam part 24 is identified with a double arrow 25. The adjustment of both cam parts 22 and 24 is performed by known adjustment eccentrics 26.

The plush plate 10 has at its rear end a control foot 27 with a return edge 28 which cooperates with the guide edge 18. In its central part a ridge 29= is formed. The ridge is provided with a step 30. A slot 32 with a flat ascending incline 31 is provided underneath in a longitudinal direction below the ridge 29=, before a slot opening. The ridge 29= ends in a driving out edge 33 which cooperates with the guiding edge 19 of the cam part 16 and the front edge 23 of the adjustable cam part 24. The plait plate 11 has at its rear end a foot 34 which is wider and higher than the foot 27 of the plush plate 10. It cooperates with its driving-out edge 35 with the guiding edge 17 of the cam parts 14 and 15 and with the front edge 20 with the adjustable cam part 22. It also cooperates with its return edge 36 with the guiding edge 18 of the cam part 16. The plait plate 11 is provided in its region of action on the threads a plait projection 37.

The plait projection 37 ends in a tip 49. A recess 38 is located under it at the height of the receiving slot 32 of the plush plate 10. The recess 38 has an edge 38= which extends to the plate tip 49. A plush thread pressing edge 50 extends from the plate tip 49 and is inclined rearwardly and upwardly so as to merge into a rear edge 51 which extends in a longitudinal direction of the plait plate 11. A driving out edge 52 extends from the rear edge 51 transversely to the latter and corresponds to the driving-out edge 33 of the plush plate 10.

Figure 2:
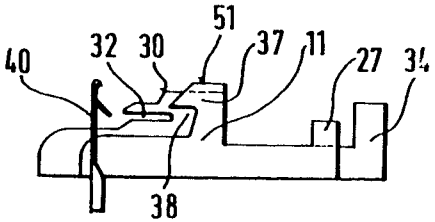
FIG. 2 is a schematic side of both plates in the overlapping position and together with a latch needle.

Both plates 10 and 11 are located close to each other in a slot in the plate ring. A smooth long side of each plate rests in the bottom of the slot. The return part of the plait plate 11 is located at the same height as the ridge 29= of the plush plate 10, or so high that it overlaps with its ridge 51 the ridge 29= of the plush plate 10. The recess is dimensionsed so that the plait plate 11 in each possible relative position relative to the plush plate 10 cannot affect the position of the thread in the needle head. FIG. 2 shows a latch needle 40 which is associated with both plates 10 and 11.

Figure 3:
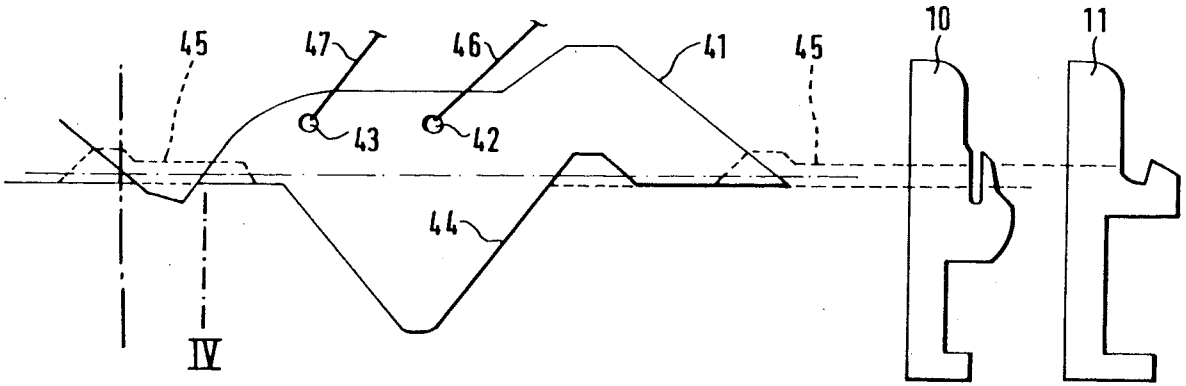
FIG. 3 is a view showing a control curve for the needle and plates with thread guiding points.

FIG. 3 shows a needle guide path 41, a supply point formed by a unshown thread guide for a, for example, elastic base thread 46, a supply point 43 for a plush thread 47, and a curve 44 for guiding the plush plate 10 and substantially the plait plate 11. A curve portion 45 which deviates from the curve 44 for the plait plate 11 is also shown. The plait plate 11 is moved by the cam part shown in FIG. 1 in accordance with the curve portion 45 in deviation from the plush plate 10. Individual needle and plate positions are shown in more detail in U.S. Pat. No. 4,535,608, particularly FIGS. 3, 6, to 8 and 11 to 13.

Figure 4:
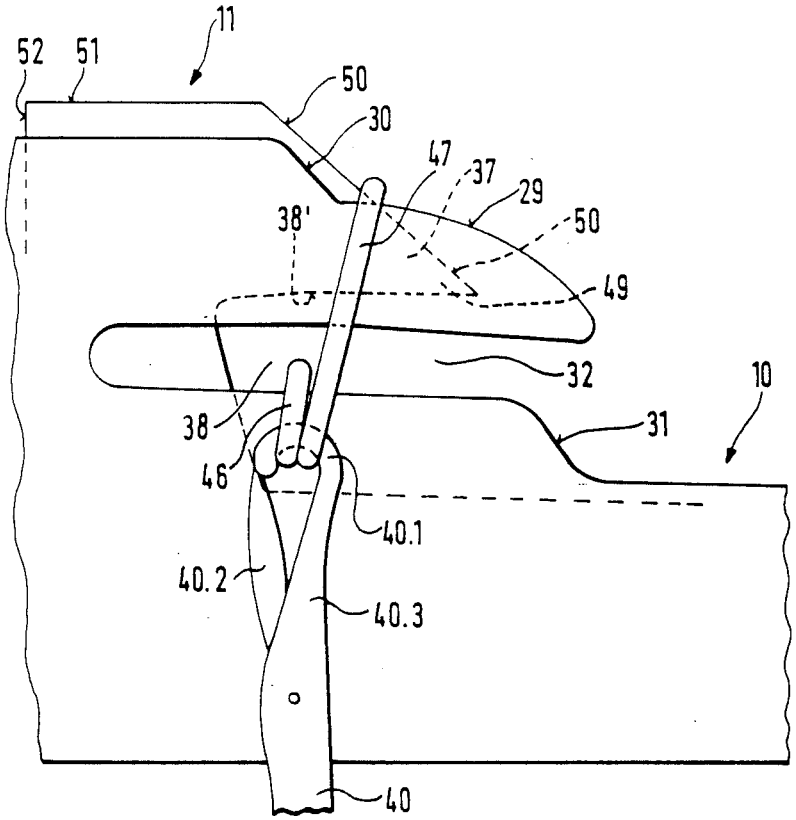
FIGS. 4 and 5 are partial side views of both plates with the associated needle at the location IV and V of the needle curve of FIG. 3.

FIG. 4 shows a relative position of a knitting tool at the point IV shown in FIG. 3, in which the needle is located at its path to its deepest sinking position. FIG. 4 shows how in this region plush thread-pressing edge 50 acts on the plush thread 47 and ensures that during sinking the loops which are together composed of the base thread 46 and the plush thread 47 hold both threads in the shown relative position relative to the needle head 40.1, and the plush threads 47 are pressed in direction to the needle shaft 40.3. The needle latch is identified with reference numeral 40.2.

Figure 5:
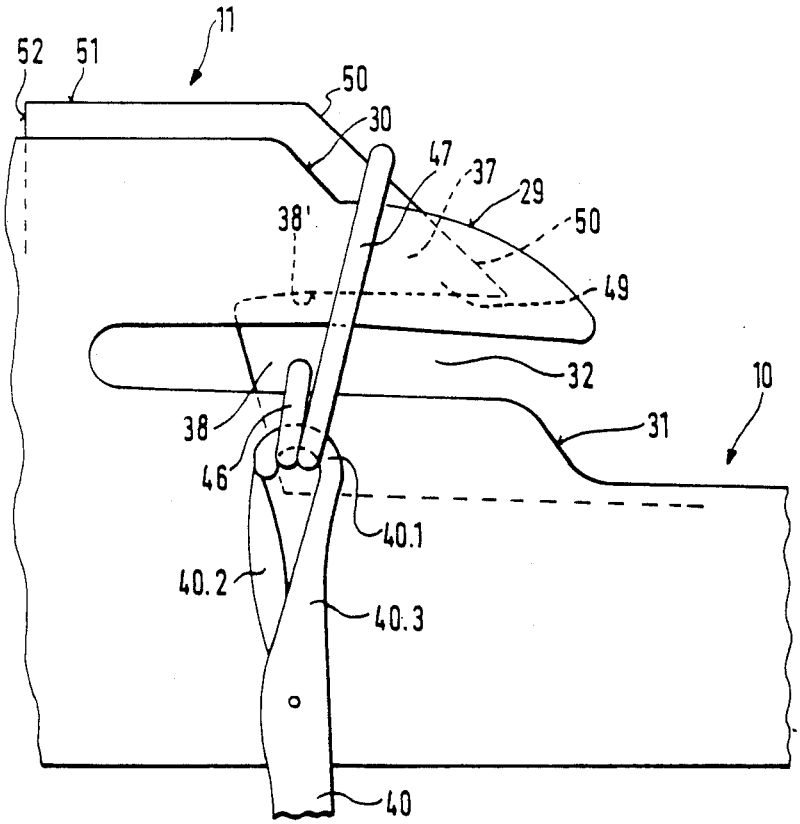

FIG. 5 shows another position of the plait plate 11 relative to the plate 10. The fully extended position of the plait plate 11 is shown in FIG. 5 and it is apparent that the action of plush thread-pressing edge 50 is not effected by the size of the recess 38 in the second plate 11. FIG. 5 corresponds to the configuration of the plates 11,10 at position V in FIG. 3.

The value of the driving-out movement of the plush plate 10 can be adjusted by the adjustable cam part 24 and adapted to the plush threads to be used. The front edge 23 of the adjustable cam part 24 acts on the driving out edge 33 of the plush plate 10. The driving-out movement of the plait plate 11 and its action on the plush thread 47 in accordance with FIG. 4 can also be adjusted by the adjustable cam part 22 and thereby adapted to the yarn to be used. Thereby a respective position of the threads and therefore an accurate plaiting of the plush hook-free rear side of the product are insured. In the vicinity of the guiding edges of the knitting tool concerning FIG. 4 the front edge 20 of the adjustable cam part 22 controls the plait plate 11 by acting on the drivingout edge 35 of the foot 34.

It will be understood that each of the elements described above, or two or more together, may also find a useful application in other types of constructions differing from the types described above.

While the invention has been illustrated and described as embodied in a circular knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A circular knitting machine for producing a single face plush article of base threads and plush threads, comprising a needle cylinder provided with a plurality of needles; a plate ring provided with separately controlled and differently shaped plates including a first plate which has a slot for receiving a base thread and a stepped ridge for applying a plush thread, and a second plate provided with a recess in the region of said slot of said first plate, said second plate having a plate tip formed above said recess and being provided for a plaiting with a plush thread-pressing edge which is formed on said plate tip and extends in an inclined manner relative to said slot of said first plate and to a shaft of an associated one of said needles, said plush thread pressing edge being positionable in the vicinity of a step of said stepped ridge of said first plate.

2. A circular knitting machine as defined in claim 1, wherein both said plates have control feet of different lengths and perform a relative displacement relative to one another by sections.

3. A circular knitting machine as defined in claim 1; and further comprising displaceable cam parts formed and positioned to cooperate with said plates to move said second plate relative to said first plate to position said plush thread-pressing edge adjacent the step of said ridge of said first plate.

* * * * *